US009010251B2

(12) United States Patent
Creissels

(10) Patent No.: US 9,010,251 B2
(45) Date of Patent: Apr. 21, 2015

(54) URBAN TRANSPORT INSTALLATION USING TRACK ROPES

(75) Inventor: Denis Creissels, Meylan (FR)

(73) Assignee: Creissels Technologies, Meylan (FR)

( * ) Notice: Subject to any disclaimer, the term of this patent is extended or adjusted under 35 U.S.C. 154(b) by 164 days.

(21) Appl. No.: 13/696,906

(22) PCT Filed: May 11, 2011

(86) PCT No.: PCT/FR2011/000292

§ 371 (c)(1),
(2), (4) Date: Nov. 8, 2012

(87) PCT Pub. No.: WO2011/141648

PCT Pub. Date: Nov. 17, 2011

(65) Prior Publication Data

US 2013/0055920 A1 Mar. 7, 2013

(30) Foreign Application Priority Data

May 12, 2010 (FR) ..... 10 02043

(51) Int. Cl.
*B61B 1/00* (2006.01)
*B61B 1/02* (2006.01)

(52) U.S. Cl.
CPC ..... *B61B 1/02* (2013.01)

(58) Field of Classification Search
CPC ..... B61B 1/00; B61B 1/02; B61B 13/00; B61B 13/04; B61B 7/00; B61B 12/022; B61B 15/00; B61B 3/00; B61B 9/00
USPC ..... 104/28, 29, 30, 89, 90, 91
See application file for complete search history.

(56) References Cited

U.S. PATENT DOCUMENTS

| | | | | | |
|---|---|---|---|---|---|
| 1,741,203 | A | * | 12/1929 | Rowe | 104/124 |
| 3,847,085 | A | * | 11/1974 | Rypinski | 104/122 |
| 3,858,518 | A | * | 1/1975 | Nyman | 104/124 |
| 4,098,036 | A | * | 7/1978 | Spoler et al. | 52/16 |
| 4,394,837 | A | * | 7/1983 | Edwards | 104/28 |
| 5,069,140 | A | * | 12/1991 | Glassey | 104/28 |
| 5,172,640 | A | * | 12/1992 | Cathiard | 104/173.2 |
| 6,240,851 | B1 | * | 6/2001 | Oudakker et al. | 104/127 |
| 2004/0134373 | A1 | * | 7/2004 | Guenther et al. | 104/89 |
| 2009/0064890 | A1 | * | 3/2009 | Charrere et al. | 104/89 |
| 2010/0319565 | A1 | * | 12/2010 | Mobasher | 104/89 |
| 2013/0055920 | A1 | * | 3/2013 | Creissels | 104/30 |
| 2013/0180425 | A1 | * | 7/2013 | Creissels | 104/28 |

FOREIGN PATENT DOCUMENTS

| | | |
|---|---|---|
| EP | 2 036 797 A1 | 3/2009 |
| FR | 1.112.175 | 3/1956 |
| FR | 2 329 490 A1 | 5/1977 |
| GB | 748067 | 4/1956 |

* cited by examiner

*Primary Examiner* — Jason C Smith
(74) *Attorney, Agent, or Firm* — Oliff PLC

(57) ABSTRACT

Overhead public transport installation for urban and peri-urban environment using track ropes with overhead stations, each comprising a platform situated below the level of the boarding/disembarkation platforms and consistent with the overhead clearance of the road transport system in terms of the difference in level that corresponds to the sag in the track ropes.

8 Claims, 3 Drawing Sheets

URBAN TRANSPORT INSTALLATION USING TRACK ROPES

FIELD OF THE INVENTION

The invention refers to an overhead public transport installation for urban and peri-urban environments comprising vehicles rolling on track ropes between overhead stations above the road transport system.

STATE OF THE ART

The creation of a new means of overhead public transport in the urban fabric above the existing road transport system obviously poses a number of problems of integration, notably of its stations for limiting their bulkiness at places where nothing has been provided for this purpose. Moreover, such a means of transport has never been taken into account in town planning projects.

Moreover, the access of passengers to the vehicles in a station from the sidewalks on both sides of the urban roads will result in an increase in their crossing and a more considerable traffic interruption, this trouble being more noticeable when the stations are located at crossroads.

The operation of the overhead transport lines imposes some constraints regarding the situation of the boarding and/or disembarkation platforms which do not very often coincide with the available places on the sidewalks for a direct access to the platforms.

OBJECT OF THE INVENTION

The object of the invention is to create a station spanning the road transport system and provided with a more or less large platform according to the need, above the overhead clearance of the road transport system and below the level of the boarding and/or disembarkation platforms while taking advantage of the height of the sags in the track ropes which heighten accordingly the level of the station platforms with respect to the overhead clearance to be respected.

The surface of the platform can be variable according to the type of stations, while being formed either by a simple footbridge between two pillars facing each other on both sides of the road transport system or by a real pedestrian square above a crossroad of several roads, which even enables to design, in a rational way, connecting stations for several transport lines crossing above the platform at different levels.

Furthermore, in addition to ensuring in a functional way the change of level of the passengers, the development of a public transport station must take into account, with regard to the users, their circulation, their waiting during a peak period, the points where tickets are sold or checked. These various constraints require to find dedicated areas that can be large in the event of dense traffic, which can be very voluminous, very difficult to find at the level of the road transport system and expensive at the upper level of the boarding/disembarkation of passengers.

The obligations to ensure the correct operation of such a means of overhead public transport, with the constraints inherent to the integration into an urban fabric which is not flexible and congested, thus result in finding new functional arrangements.

The platform of a station according to the invention is located under the level of boarding/disembarkation of passengers, and above the overhead clearance of the road transport system because of the sag in the track ropes. The pillars located outside the road transport system support the platform and comprise means of access to the platform from the sidewalks.

Thus the platform according to the invention:

- is freely open to pedestrians and users,
- allows users only to reach the upper overhead transport level and in an essential way,
- reconstitutes all the areas necessary for the good operation (in particular when the traffic is dense) of the transport system, which is impossible to find at the ground level,
- ensures, on the one hand, regarding pedestrians, a sure means of crossing the roads, and on the other hand, regarding traffic, an improvement thanks to a reduction in the number of pedestrian crossings.

According to a feature of the invention, there are two pillars on both sides of the station, and the means of access preferably comprise elevators leading to the intermediate level of the footbridge and the upper level of the boarding/disembarkation platforms.

According to a feature of the invention, each pillar is provided with two elevators in order to ensure the availability of operation.

According to another feature, the elevators have doors perpendicular to the installation tracks allowing a pedestrian circulation at all the levels, in particular at the level of the road transport system.

The platform according to the invention can comprise first free zones of use for pedestrians, and second zones only for the users of the public transport, and comprising a number of services.

The users can reach the upper boarding level from the lower level of the road transport system via a first free access way leading to the platform from places outside the traffic, and the dedicated boarding/disembarkation gates of the public transport from the platform via a second access way for users only.

Regarding this second access way, the elevators can be provided with automatic doors opening at the upper level facing and against those of the vehicle. The elevator car thus has a triple function of double-entrance security door, vertical transport and platform. By this means, there is no plate above the platform, which reduces considerably the visual impact of the station.

In the case of a vehicle having two side doors on the opposite sides, the access to the vehicle is given by two elevators, one for boarding, and the other for disembarking.

BRIEF DESCRIPTION TO THE FIGURES

Other advantages and features of the invention will more clearly arise from the following description of various embodiments of the invention given as examples and represented in the annexed drawings, in which.

DESCRIPTION OF THE INVENTION

Figure 1:
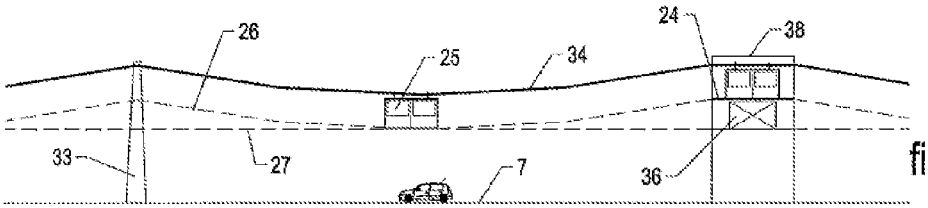
FIG. 1 is a line profile of an installation using ropes and provided with a station according to the invention.

FIG. 1 represents a line profile of an installation using track ropes 34 on which a vehicle 25 circulates, in particular a cablecar, along a trajectory 26 above the level of the road transport system 7. The footbridge 36 or platform is placed under the level of the platforms 24 of a station 38, which must be higher than the overhead clearance 27 because of the sag in the track ropes.

Figure 2:
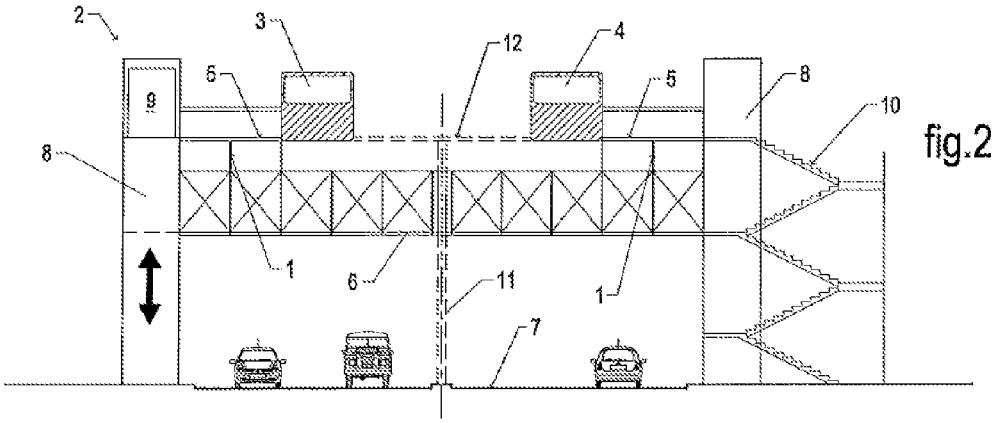
FIG. 2 is a cross view of a station according to the invention for an installation comprising two vehicle running tracks at the same level.

FIG. 2 represents a station 2 in which vehicles 3 and 4, each of them running in a different direction, stop in front of the boarding platforms 5. The station 2 comprises two pillars 8 located on both sides of the road transport system 7 and supporting a platform 6 located under the levels of the platforms 5 it supports via posts 1. The accesses to the platform 6 and boarding platforms 5 from the road transport system 7 are represented by two different systems which are elevators 9 or staircases 10 integrated in the pillars 8. According to the span of the platform 6, there may be one or more intermediate supports 11 which can also be used as support for possible platforms 12 located between the two running tracks for the vehicles 3 and 4.

Figure 3:
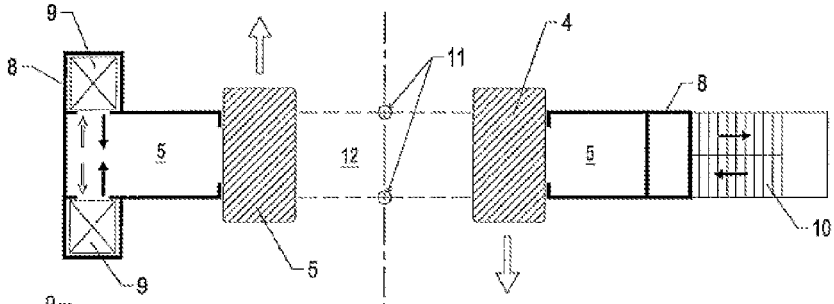
FIG. 3 is a top view of the platform level in FIG. 2.
Figure 4:
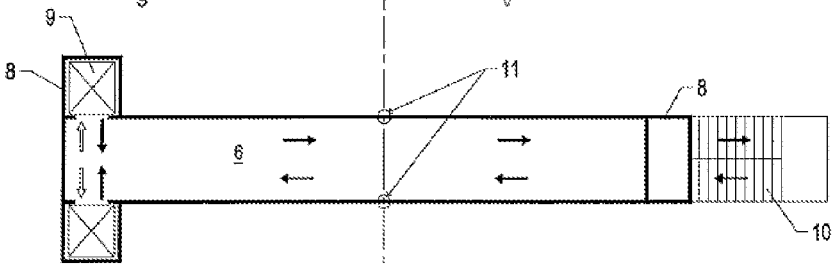
FIG. 4 is a top view of the footbridge level in FIG. 2.
Figure 5:
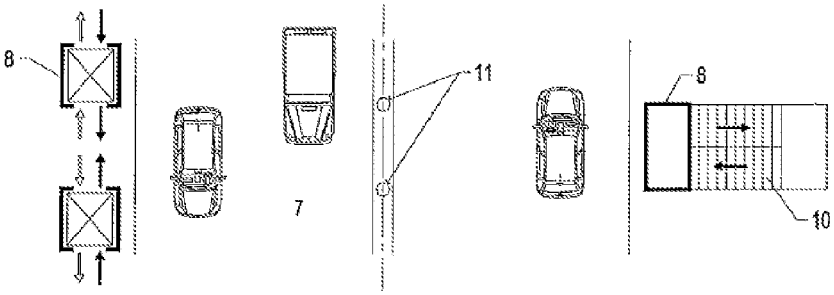
FIG. 5 is a top view of the road transport system level in FIG. 2.

FIGS. 3, 4 and 5 are top views of the various levels of a station 2 according to FIG. 2. The doors of the elevators 9, located in one of the pillars 8, are advantageously arranged so as to allow a rational access of the users in the longitudinal direction of the road transport system 7, FIG. 5 showing the possibility of accessing to the elevators while encroaching at a minimum upon the sidewalk width.

Figure 6:
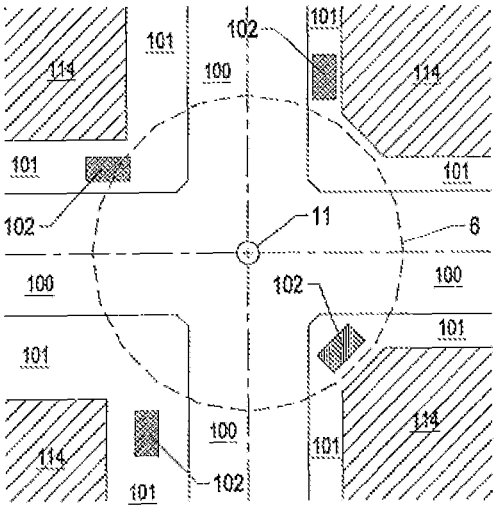
FIG. 6 represents a top view of a town square including a function of two avenues with accesses to the platform according to the invention.

FIG. 6 represents an intersection of two avenues 100 forming the road transport system 7 between the buildings 114 of an urban zone, which avenues are bordered by sidewalks 101 on which pedestrians can walk. These pedestrians can reach the platform 6 according to the invention, represented here in dotted lines in the center of the intersection of the two avenues 100, through accesses 102, advantageously formed by elevators 9, escalators 115 or staircases 10, located at strategic places on the sidewalks 101.

Figure 7:
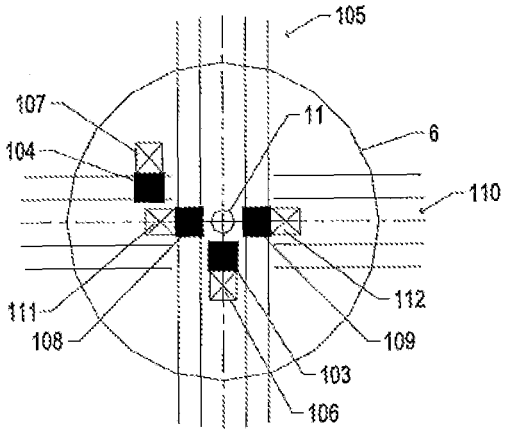
FIG. 7 represents a top view of two overhead transport lines located above the running tracks and crossing at different levels, with the stopping position of the vehicles, and their contiguous vertical access from the platform.

FIG. 7 represents an overhead transport line 105 crossing a second overhead transport line 110 located at a higher level. The stopping places of the vehicles 108, 109 running on the line 105 are contiguous with their vertical accesses 111, 112 from the level of the platform 6. In the same way, the stopping places of the vehicles 103, 104 running on the line 110 are contiguous with their vertical accesses 106, 107 from the level of the platform 6.

Figure 8:
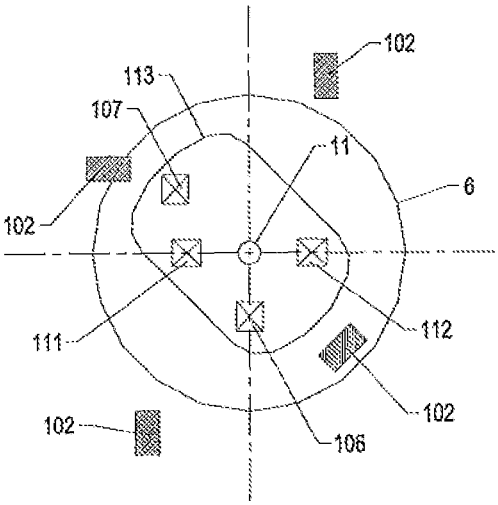
FIG. 8 represents a top view of the platform with the locations of the accesses from the sidewalks corresponding to FIG. 6, and the accesses for the boarding/disembarkation into/from the idle vehicles of the two overhead lines at different levels, corresponding to FIG. 7.

FIG. 8 is a top view of the level of the platform 6 on which is arranged a zone 113 for the users of the urban transport who use the vertical accesses (106, 107, 111, 112) for the boarding/disembarkation into/from the idle vehicles (103, 104, 108, 109) of the two lines (105, 110).

Figure 9:
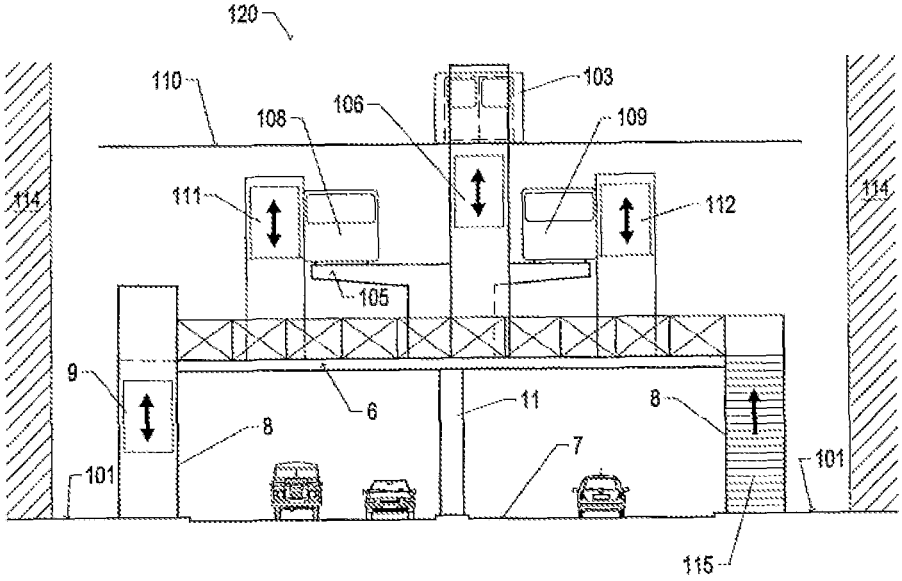
FIG. 9 represents a front view of the superposition of the different levels in FIGS. 6, 7 and 8.

FIG. 9 represents a station 120 in which vehicles 108, 109, each of them running in a different direction on the overhead track 105, stop in front of their respective vertical boarding/disembarkation accesses 111, 112 and vehicles 103, 104, each of them running in a different direction on the overhead track 110 located at a higher level, stop in front of their respective vertical boarding/disembarkation accesses 106, 107. The station 120 comprises two pillars 8 located on both sides of the road transport system 7 and supporting a footbridge 6 located under the level of the tracks 105, 110.

The accesses to the platform 6 from the road transport system 7 are represented by two different systems which are elevators 9 or escalators 115 integrated in the pillars 8. One can reach the vehicles 103, 104, 108, 109 from the platform 6 through the corresponding vertical accesses 1056, 107, 111, 112.

According to an alternative embodiment, each vehicle has two side doors on the opposite sides, the boarding/disembarkation into/from two successive vehicles being performed alternatively via two elevators, one for the doors on one side of the vehicle and the other for the doors on the other side.

The invention claimed is:

1. An urban public transport installation comprising a plurality of stations; and a plurality of track ropes between the stations, wherein the track ropes are designed for vehicles to travel between the stations via the track ropes and the track ropes are above a road from which another vehicle travels below, wherein each station including:

a vertical pillar on each side of the road;

a footbridge that is configured to be used by pedestrians and users, wherein the footbridge spans the road and is supported by the vertical pillar on each side of the road; and a boarding/disembarkation level for passengers to board and disembark the vehicles, wherein the footbridge is located below the boarding/disembarkation level and above the road and a height of the boarding/disembarkation level is dependent on a sag of the track ropes between the stations, wherein the vertical pillars include means to access the footbridge from the road.

2. The urban public transport installation according to claim 1, wherein the vertical pillar on each side of the road includes two pillars on each side of the road, and the means to access the footbridge includes elevators which lead to the footbridge and the boarding/disembarkation level.

3. The urban public transport installation according to claim 2, wherein each pillar is provided with two elevators.

4. The urban public transport installation according to the claim 1, wherein the pedestrians and the users can reach the footbridge from the road via a first free access way, and only users can reach the boarding/disembarkation gates from the footbridge via a second access way.

5. The urban public transport installation according to claim 4, wherein each of the vehicles has two side doors on opposite sides, and access to the vehicles is given by two elevators, one for boarding, and the other for disembarking.

6. The urban public transport installation according to claim 4, wherein the footbridge is arranged so as to allow the users a connection between two overhead lines crossing at different levels.

7. The urban public transport installation according to claim 4, wherein each of the vehicles has two side doors on opposite sides, and the passengers can board and disembark the vehicles into/from two successive vehicles alternatively via two elevators, one for the doors on one side of the vehicles and the other for the doors on the other side of the vehicles.

8. The urban public transport installation according to claim 1, wherein a lower level of the footbridge corresponds to a maximum sag of the track ropes between the stations.

* * * * *